US005379473A

United States Patent [19]

Rief et al.

[11] Patent Number: 5,379,473

[45] Date of Patent: Jan. 10, 1995

[54] AUTOMATIC SWIMMING POOL CLEANER

[75] Inventors: Dieter J. Rief, Rohnert Park; Herman E. Frentzel, Sausalito, both of Calif.

[73] Assignee: Sta-Rite Industries, Inc., Delavan, Wis.

[21] Appl. No.: 145,807

[22] Filed: Nov. 1, 1993

Related U.S. Application Data

[63] Continuation-in-part of Ser. No. 52,699, Apr. 27, 1993, Pat. No. 5,293,659, which is a continuation of Ser. No. 771,787, Oct. 4, 1991, abandoned, which is a continuation of Ser. No. 758,005, Sep. 12, 1991, abandoned, which is a continuation-in-part of Ser. No. 586,425, Sep. 21, 1990, abandoned.

[51] Int. Cl.[6] ..... E04H 3/20

[52] U.S. Cl. ..... 15/1.7

[58] Field of Search ..... 15/1.7

[56] References Cited

U.S. PATENT DOCUMENTS

| | | | |
|---|---|---|---|
| 2,453,376 | 11/1948 | Lagasse . | |
| 3,803,658 | 4/1974 | Raubenheimer | 15/1.7 |
| 3,936,899 | 2/1976 | Henkin . | |
| 3,979,788 | 9/1976 | Strausak . | |
| 4,023,227 | 5/1977 | Chauvier | 15/1.7 |
| 4,133,068 | 1/1979 | Hofmann . | |
| 4,152,802 | 5/1979 | Chauvier . | |
| 4,156,948 | 6/1979 | Chauvier et al. . | |
| 4,275,474 | 6/1981 | Woodard | 15/1.7 |
| 4,351,077 | 9/1982 | Hofman . | |
| 4,409,851 | 10/1983 | Bahrton . | |
| 4,449,265 | 5/1984 | Hoy . | |
| 4,536,908 | 8/1985 | Raubenheimer | 15/1.7 |
| 4,642,833 | 2/1987 | Stoltz et al. . | |
| 4,686,728 | 8/1987 | Rawlins . | |
| 4,692,956 | 9/1987 | Kassis . | |
| 4,722,110 | 2/1988 | Chandler . | |
| 4,761,848 | 8/1988 | Hofmann . | |
| 4,778,599 | 10/1988 | Brooks . | |
| 4,807,318 | 2/1989 | Kallenbach . | |
| 4,817,225 | 4/1989 | Stoltz . | |
| 4,835,809 | 1/1989 | Roumagnac . | |
| 4,849,024 | 7/1989 | Supra . | |
| 4,852,211 | 8/1989 | Strausak . | |
| 4,920,599 | 5/1990 | Rief . | |
| 4,939,806 | 7/1990 | Supra . | |
| 5,001,800 | 3/1991 | Parenti et al. . | |
| 5,014,382 | 5/1991 | Kallenbach . | |
| 5,033,148 | 7/1991 | Chauvier et al. . | |
| 5,044,034 | 9/1991 | Iannucci . | |
| 5,093,950 | 3/1992 | Heier . | |
| 5,097,559 | 3/1992 | Brunt et al. . | |
| 5,099,535 | 3/1992 | Chauvier et al. . | |

FOREIGN PATENT DOCUMENTS

| | | |
|---|---|---|
| 1202755 | 6/1983 | Canada . |
| 648893 | 12/1978 | Switzerland . |

*Primary Examiner*—Edward L. Roberts
*Attorney, Agent, or Firm*—Jansson & Shupe, Ltd.

[57] ABSTRACT

An automatic swimming pool cleaner having a vibrator on the pool cleaner housing, main bristles projecting to main-bristle ends for supporting the device on a surface to be cleaned, the main bristles inclined such that vibration causes forward movement, and secondary bristles in fixed position projecting to secondary-bristle ends, the secondary bristles inclined in a different direction than the main bristles such that, upon contact with the surface to be cleaned, vibration causes a turning away from the forward direction.

22 Claims, 7 Drawing Sheets

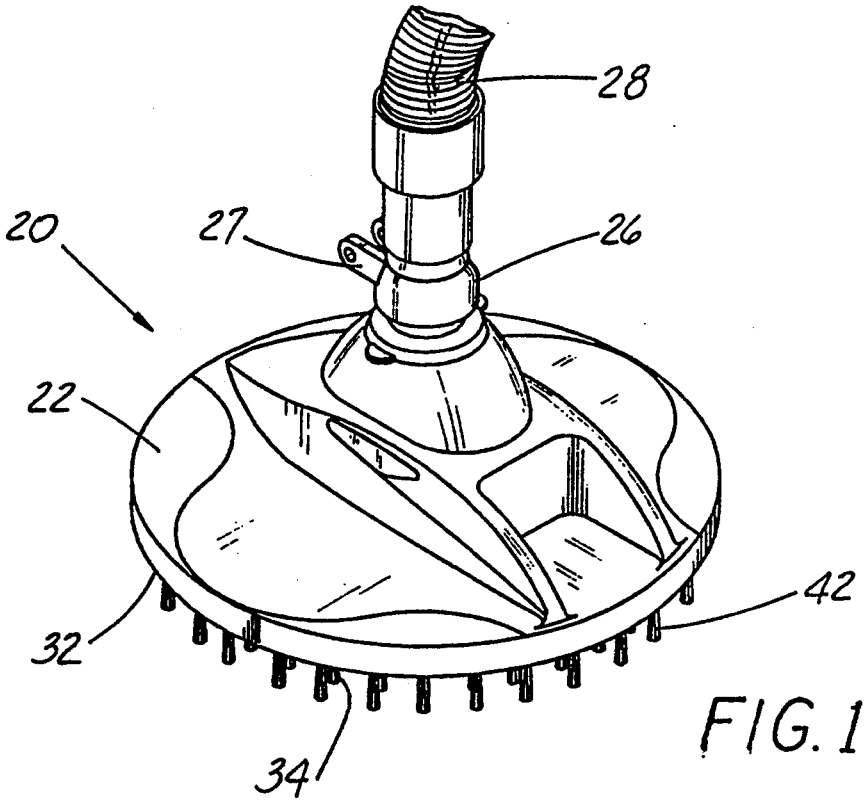
FIG. 1
FIG. 2
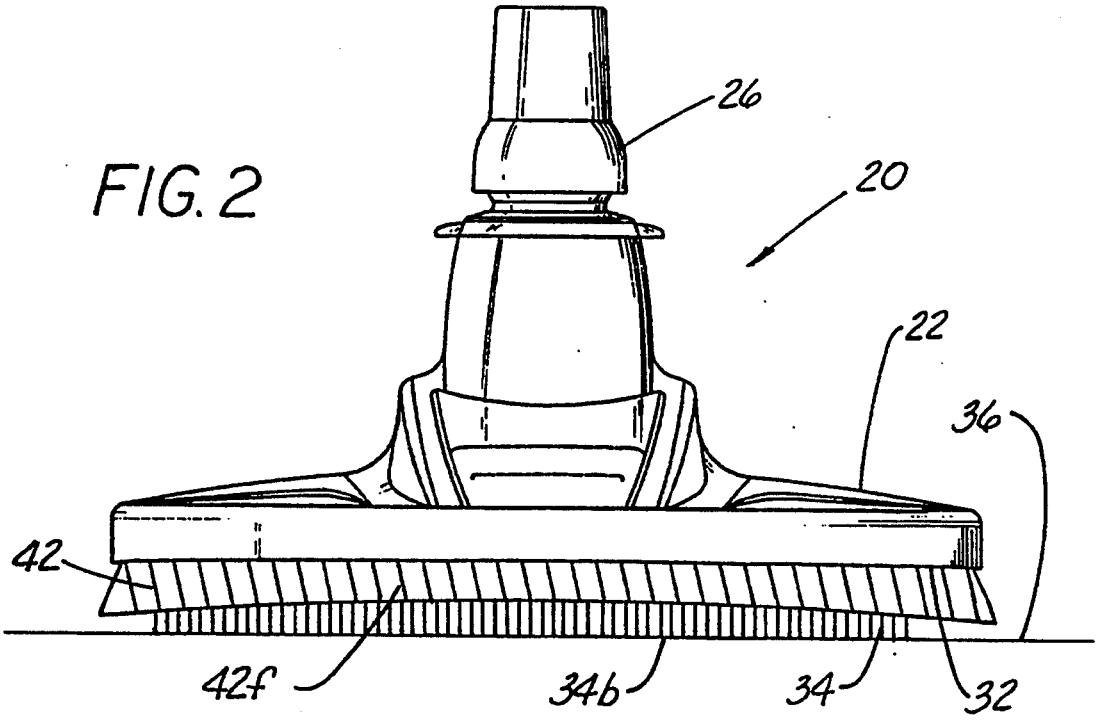

AUTOMATIC SWIMMING POOL CLEANER

Related Applications

This patent is a continuation-in-part of Ser. No. 08/052,699, now U.S. Pat. No. 5,293,659, filed Apr. 27, 1993, entitled AN AUTOMATIC SWIMMING POOL CLEANER, which is a continuation of Ser. No. 07/771,787, filed Oct. 4, 1991 and later abandoned, which is a continuation of Ser. No. 07/758,005, filed Sep. 12, 1991 and later abandoned, which is a continuation-in-part of Ser. No. 07,586,425, filed Sep. 21, 1990 and later abandoned.

FIELD OF THE INVENTION

This invention is related generally to swimming pool cleaners and, more particularly, to swimming pool cleaners which operate without human assistance.

BACKGROUND OF THE INVENTION

Automatic swimming pool cleaners are widely used to relieve swimming pool owners of the time-consuming and arduous task of hand-operated vacuuming of underwater surfaces. Such manual task, which typically involved the use of long extension handles and clumsy manipulation of a water-suction head held under water and at a distance, have largely been made a thing of the past by automatic systems. In recent decades, many automatic swimming pool cleaners of various types have been available and in wide use around the world.

A typical old-style automatic swimming pool cleaner has a suction head including a housing, a chamber open at its lower side, and a pivotable connector to which a long flexible hose is attached to allow movement of the swimming pool cleaner in the pool. The hose typically extends toward a remote pump which causes water flow from along the pool bottom surface, through the chamber and into the hose, removing dirt and debris from the bottom surface of the pool.

In old-style systems of this type, the flow of water caused by the pump is harnessed in various ways to cause movement of the swimming pool cleaner. In some old-style devices, the flow drives a turbine which in turn drives wheels or tracks by means of a gearing system. In other old-style devices, the water flow rate oscillates such that rapid intermittent surging of water flow causes movement along the underwater swimming pool surface.

There have been many problems and shortcomings with various old-style automatic swimming pool cleaners, and a clear need for improvement. Many of such devices are complex and expensive. Such devices also malfunction for various reasons, such as their frequent failure to move along the underwater pool surface as desired and intended.

The U.S. patent mentioned above, of which this is a continuation-in-part, discloses a significant improvement in automatic swimming pool cleaners of the type having a suction-head housing, a chamber open at its lower side, and attachment means for a hose through which a remote pump causes water flow through the chamber and into the hose to remove dirt and debris from the underwater surface of the pool. Such invention can be described as the "bristle-drive" automatic swimming pool cleaner.

The apparatus of such patent includes a vibrator device secured to the housing to vibrate the head in response to water flow through the chamber, and flexible bristles or the like secured with respect to the housing and projecting downwardly to free ends which support the suction head on a swimming pool surface to be cleaned. A preponderance of the bristles are inclined (at an angle) in a common direction, a direction which is off-vertical when the suction head is on a horizontal pool bottom surface, such that vibration causes forward head movement.

As described in such patent, water flow which is generated by the pump passes through an oscillator in the suction head causing a vibration of the suction head, and such vibration acts upon the brush bristles or other flexures, causing them to flex and causing the suction head to move forward as the bristles return to their normal straight configurations. The rapid repetition of this flexing and straightening of the bristles drives the suction head about the underwater surface of the swimming pool. And in such motion the bristles, which are vibrating from vibration of the suction head, scour the underwater pool surface which they contact. The dirt and debris displaced by such action is drawn up through the cleaner into a typical filter system, resulting in a thoroughly cleaned pool.

Such patent describes various devices and systems for turning the swimming pool cleaner as it moves along underwater surface of a swimming pool. Such devices harness mechanical movement of the vibrator to periodically impose, on the swimming pool surface being cleaned, a foot-like device in an off-center position, which causes turning of the forward motion as the swimming pool cleaner pivots to some extent about such foot until it is withdrawn.

It has now been found that other unique and highly beneficial approaches may be taken to turning the direction of forward movement of the suction head. These other approaches for turning "bristle-drive" automatic swimming pool cleaners represent significant improvements in the field of automatic swimming pool cleaners. Such improvements, various forms of which are described herein, have particular usefulness for certain types of swimming pool cleaners, such as swimming pool cleaners for above-ground pools.

OBJECTS OF THE INVENTION

It is an object of this invention to provide an improved automatic swimming pool cleaner which overcomes some of the problems and shortcomings of devices of the prior art.

Another object of this invention is to provide an automatic swimming pool cleaner which reliably cleans the underwater surface of a swimming pool.

Another object of this invention is to provide an automatic swimming pool cleaner which moves automatically in random fashion along the underwater swimming pool surface when a suction flow of water passes through its suction head.

Another object of this invention is to provide an improved automatic swimming pool cleaner which can change its direction of movement automatically.

Another object of this invention is to provide an improved automatic swimming pool cleaner which can change its direction of movement automatically and which is free of turbines, gears, wheels and other similar moving mechanical devices.

Another object of this invention is to provide an improved automatic swimming pool cleaner which is simple in construction and highly reliable in operation.

Another object of this invention is to provide an improved automatic swimming pool cleaner which may be readily adjusted to accommodate varying swimming pool bottom surfaces.

A still further object of this invention is to provide an improved automatic swimming pool cleaner which can be easily and rapidly disassembled for cleaning and maintenance purposes and re-assembled without the use of complex tools.

These and other important objects will be apparent from the descriptions and drawings herein.

SUMMARY OF THE INVENTION

This invention is an improved swimming pool cleaner suction head of the type having a housing, a chamber open at the lower side of the housing, and a hose connection on the housing allowing connection of a hose through which a remote suction pump causes water flow through the chamber and into the hose, removing dirt and debris from the underwater surface of the pool. More specifically, this invention is an improvement in what might be referred to as the "bristle-drive" automatic swimming pool cleaner invention of the U.S. patent first mentioned above.

The device of this invention includes a vibrator device secured to the housing to vibrate the head, preferably in response to water flow through the chamber, and flexible main bristles secured with respect to the housing and projecting downwardly to terminate in free main-bristle ends which are preferably disposed substantially in a common plane and adapted to support the head on a swimming pool surface to be cleaned. A preponderance of the main bristles are inclined such that, when their ends engage a horizontal pool bottom surface, the main bristles deviate from vertical in a common direction and vibration causes forward head movement.

The device of this invention includes at least one group of vertically-fixed secondary flexible bristles secured with respect to the housing and projecting downwardly to terminate in secondary-bristle ends. The secondary bristles are positioned for off-center bristle-end engagement with the surface to be cleaned, and the secondary bristles deviate from vertical in a direction other than the common direction (that is, the direction of main-bristle deviation from vertical) such that, upon contact of secondary-bristle ends with the surface to be cleaned, vibration causes a turning of the head away from the forward direction.

As used herein, "vertically-fixed" means that during operation of the device of this invention in a swimming pool, the secondary bristles are in substantially fixed vertical position with respect to the housing and with respect to the position of the main bristles. As will be seen, although vertically-fixed during a pool-cleaning operation, the secondary bristles in certain preferred embodiments can be adjustable from one vertically-fixed vertical position to another—and such adjustment can be useful in tuning the operation of the invention for a underwater pool surface of a different nature (for example, flatness or roughness, etc.).

In preferred embodiments, the secondary-bristle ends are positioned with respect to the common plane such that, during motion of the device along the surface being cleaned, the secondary-bristle ends at least periodically engage off-planar portions (for example, irregularities) of the surface to be cleaned. When this occurs, a turning in the forward movement of the device at least intermittently occurs.

Secondary bristles in accordance with this invention can come in a great many forms and arrangements. Some of the most preferred forms and arrangements of secondary bristles are described in this patent.

In certain highly preferred embodiments of this invention, the housing has a lower edge surrounding the chamber and the main bristles are secured along such housing lower edge with the secondary-bristle group being at a position or positions spaced from the lower edge. In certain preferred forms, the housing has a downwardly-facing middle surface surrounded by the lower edge and the at least one secondary-bristle group is secured to such middle surface.

In certain preferred arrangements, a pair of secondary-bristle groups are disposed on opposite sides of the center of the housing bottom, most preferably secured to the downwardly-facing middle surface of the housing as noted. In one particularly preferred arrangement, at least one of the two secondary-bristle groups is removably secured with respect to the housing, and removal and securement are such that the bristle group may be secured with its secondary bristles in either of at least two different orientations.

In one highly preferred embodiment involving two secondary-bristle groups in opposite positions with respect to the center of the housing bottom, the bristles of the two secondary-bristle groups are oppositely inclined to one another. This serves to impart an enhanced rotational motion to the suction head, which facilitates turning of the suction head from its direction of forward movement.

In certain very highly preferred embodiments involving at least one secondary-bristle group secured to the downwardly-facing middle surface of the housing, there also are side bristles affixed along the lower edge at positions outside the main bristles, most preferably an annulus or surrounding curtain of side bristles. Such side bristles project both outwardly and downwardly and preferably terminate short of the common plane, and they are disposed at a rotational angle such that engagement of the side bristles with the pool bottom surface, or with pool side walls as the suction head bumps such side walls, causes a turning deflection of the pool cleaner.

In the most preferred embodiments having such side bristles, the side bristles at all locations around the housing lower edge are oriented such that projections of the side bristles on the common plane would be angled (rather than straight) with respect to radii extending from such projections toward the center point of the common plane (that is, the point below the center of the housing). Thus, contact of any of such side bristles with the swimming pool wall would impart turning in one rotational direction, clockwise or counterclockwise.

Turning again to a description of the main bristles, in preferred embodiments the main bristles are secured to a main-bristle ring and such ring is a device which is removably secured along the lower edge of the housing. In embodiments having the aforementioned side bristles, the side bristles are secured to a side-bristle ring and such ring is a device which is removably secured along the lower edge of the housing, but at a position outside (that is, radially outside) the main-bristle ring.

Certain of the most preferred versions of such embodiment of this invention include a tilt mechanism engaging the side-bristle ring to adjust its orientation with respect to the common plane. More specifically, a portion of such side-bristle ring, such as the portion adjacent the rear of the swimming pool cleaner, can be moved slightly either toward or away from the common plane. As explained further later, this can adjust the extent of turning which occurs by virtue of contact of a portion of the side bristles with, for example, the horizontal bottom surface on which the swimming pool cleaner is moving.

The bristles referred to herein as "secondary bristles" can be included in a variety of forms. Indeed, the bristles of the side-bristle ring just described obviously function as "secondary bristles" in causing turning of the swimming pool cleaner, and thus are "secondary bristles." Such secondary bristles can be in conjunction with others, such as the secondary-bristle groups already described which are more centrally located on the bottom of the swimming pool cleaner, or can be the only secondary bristles.

Describing such situations in greater detail, the housing has a lower edge surrounding the chamber and the vertically-fixed secondary flexible bristles are affixed along the lower edge. Such secondary bristles preferably project both outwardly and downwardly such that the preponderance of such bristles terminate generally short of the common plane. And, as earlier described with respect to "side bristles," such secondary bristles are most preferably disposed at a rotational angle such that their engagement with a pool bottom surface causes a turning deflection of the pool cleaner.

In preferred embodiments of this sort, the main bristles are also secured generally along the lower edge of the housing, with the secondary bristles positioned outside (beyond) the main bristles. The main bristles are most preferably secured to a main-bristle ring as earlier described, and a separate secondary-bristle ring is likewise removably secured along the lower edge of the housing.

The secondary-bristle ring preferably includes a front portion, an opposite rear portion, and portions therebetween. In particularly preferred embodiments, the secondary-bristle ring has a circumferential portion, referred to herein as a low circumferential portion, the secondary bristles of which have bristle ends closer to the common plane—that is, closer than the ends of the other secondary bristles are to such common plane. The low circumferential portion is preferably the rear portion of the secondary-bristle ring.

Such bristles of such lower circumferential portion of the secondary-bristle ring, which may even be as low as about the level of the common plane, are effective during forward movement of the swimming pool cleaner to cause turning away from the forward direction. The extent to which this occurs depends upon the precise vertical position of the secondary bristle tips at such low circumferential portion and upon the flatness of the swimming pool surface.

Certain preferred examples of a secondary-bristle ring having a circumferential portion which is low (compared to other circumferential portions of the secondary-bristle ring) also include a tilt mechanism engaging the secondary-bristle ring to adjust its orientation. Such device allows adjustment, of as little as a few millimeters toward or away from the common plane, in the vertical position of the secondary bristles, at least those along the low circumferential portion of the secondary-bristle ring. Such adjustment of the vertical position of secondary bristles is useful in increasing or deceasing the amount of turning action.

Such tilt mechanism is preferably a camming device which acts between the housing and the secondary-bristle ring to raise and lower the low circumferential portion of the secondary-bristle ring. The camming device is preferably turned by hand or by the turn of a screw driver or the like.

BRIEF DESCRIPTION OF THE DRAWINGS

FIG. 1 is a perspective view of a preferred automatic swimming pool cleaner in accordance with this invention.

FIG. 2 is a front elevation of the device of FIG. 1.

Figure 4:
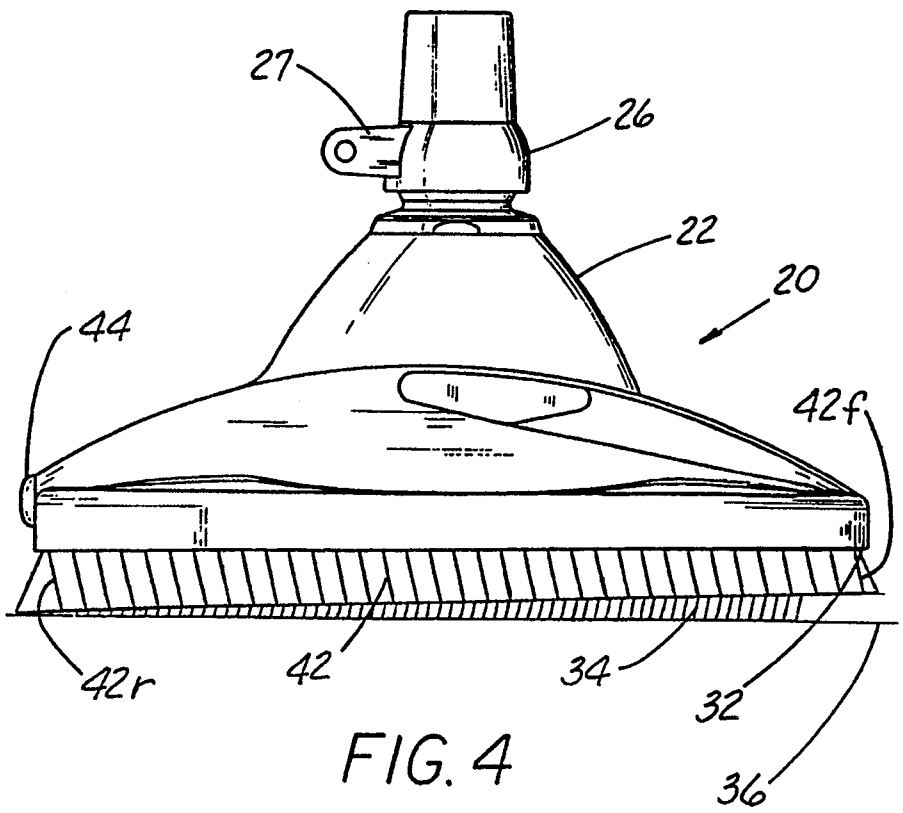
FIG. 4 is a side elevation.

As will be noted, for reasons of convenience several of the figures represent bristles somewhat schematically, rather than in actual form. The required characteristics of such bristles, however, is disclosed by such figures and by the written descriptions herein.

DETAILED DESCRIPTION OF PREFERRED EMBODIMENTS

FIG. 1 and all the other figures illustrate an automatic swimming pool cleaner suction head 20 in accordance with this invention. Suction head 20 has a housing 22, a chamber 24 (see FIGS. 6, 8 and 9) which is open at the lower side of housing 22, and a pivotable hose connection 26 on housing 22 allowing connection of a hose 28 through which a remote suction pump (not shown) causes water flow through chamber 24 and into hose 28, removing dirt and debris from the underwater surface of the pool. Lugs 27 at hose connection 26 may be used in attaching a pole (not shown) when the swimming pool cleaner is used in a manual mode.

As shown best in FIGS. 5, 6, 8 and 9, chamber 24 includes a central outflow portion **24*a* and a surrounding inflow portion 24*b* which extends to the periphery of housing 22. As shown in FIGS. 6–9 and 13, suction head 20 includes a vibrator 30 in outflow portion 24*a* of chamber 24. Vibrator 30 is pivotably secured to housing 22 by means of a shaft 30*a*, and is designed to freely oscillate within outflow chamber portion 24*a* in response to water flow through chamber portion 24*a***. As shown best in FIGS. 7 and 8, shaft 30*a* is journaled in holes 30*b* in housing 22 and is held in place by retainer plates 30*c* which are engaged with housing 22.

Figure 7:
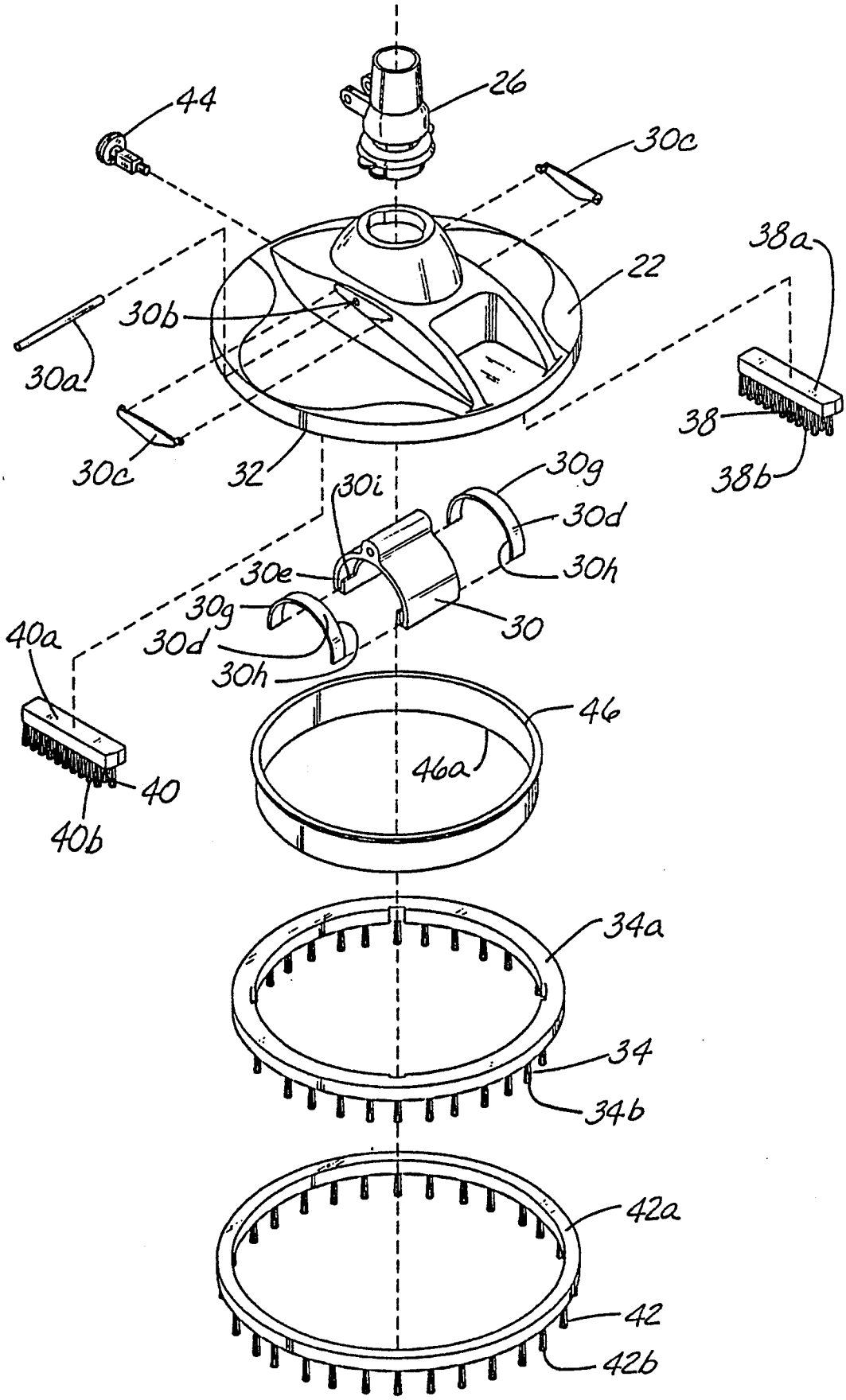
FIG. 7 is an exploded view.
Figure 9:
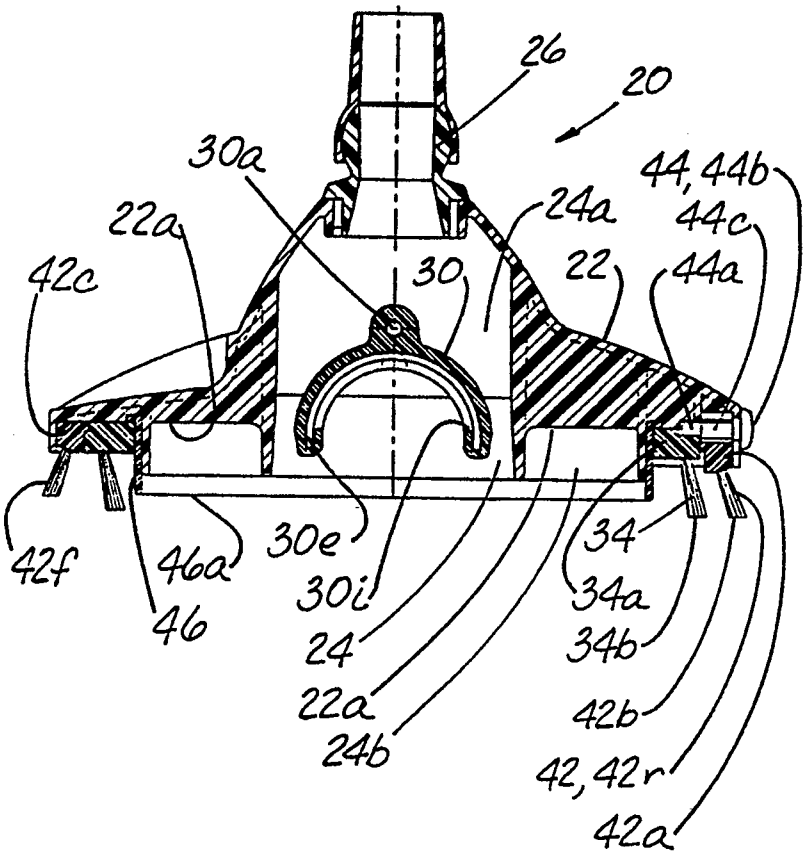
FIG. 9 is a sectional view taken along section 9—9 as indicated in FIG. 5.
Figure 13:
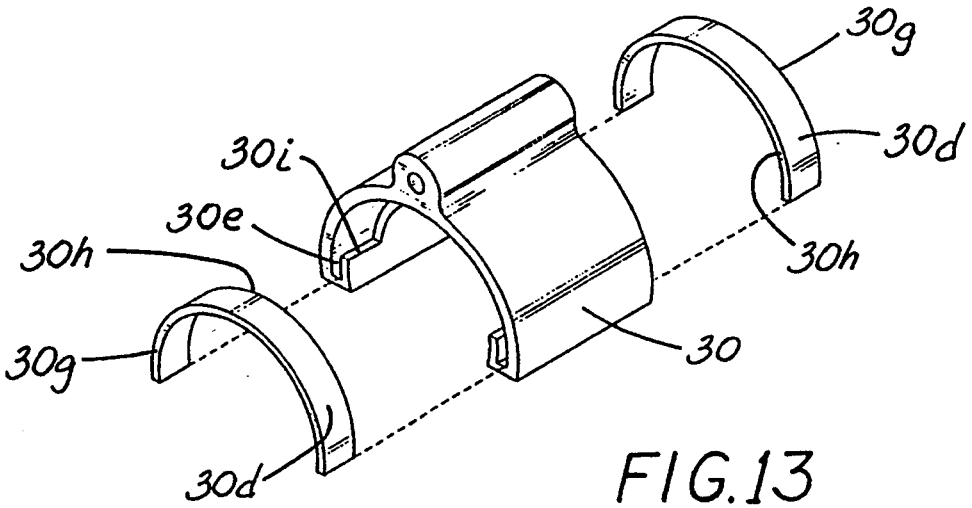
FIG. 13 is an enlarged exploded perspective view of the vibrator device used in the automatic swimming pool cleaner.

As shown in FIGS. 7, 9 and 13, vibrator 30 has a crescent-like or airfoil-like cross-section and is located in dome-like outflow chamber portion 24 with its convex side oriented toward hose connection 26. The profile and dimensions of vibrator 30 have been developed to provide a self-starting and relatively constant speed vibration which is powered by the flow of water up toward outlet hose 28. Flow of water causes an oscillation of vibrator 30, and the oscillatory momentum and impact forces (including movements of water mass) are imparted to housing 22 to cause vibratory motion.

As shown in FIGS. 6–8 and 13, a pair of arc-like sliding seals 30*d* are carried in lateral slots 30*e* on either opposite edge of vibrator 30 in position to engage opposed inner side walls 30*f* of chamber portion 24. Sliding seals 30*d* serve to seal vibrator 30 to side walls 30*f* and prevent excessive by-pass of water and yet allow sand or other small particles to escape to avoid clogging and lock-up and to avoid damage to parts. Sliding seals 30*d* can move inwardly as necessary to accommodate the passing of sand or other particles.

Sliding seals 30*d* are forced toward side walls 30*f* by the difference in hydraulic pressure between opposite edges of each of the sliding seals. Lower pressure fluid is exposed to seal outer edges 30*g* than is exposed to seal inner edges 30*h* (see. FIGS. 6, 7, 8 and 13), and the higher pressure along seal inner edges 30*h* pushes seals 30*d* outwardly toward the lower pressure or suction sides of seal 30*d* (that is, in the direction toward seal outer edges 30*g*), causing engagement with side walls 30*f*.

As shown in FIGS. 6–9 and 23, best in FIG. 13, the lateral slot-forming portions of vibrator 30 have deep notches 30*i* which facilitate effective operation of the pressure differential in allowing pressure-driven outward movement of sliding seals 30*d*. Notches 30*i* also serve to fully expose much of the surfaces of seals 30*d*, allowing seals 30*d* to remain free to move within lateral slots 30*e*—by reducing or eliminating spaces where sand or dirt particles could accumulate to interfere with operation.

As already noted, vibrator 30 causes vibration of housing 22 as water passes through suction head 20. And, as in the invention of the above-noted patent, vibration acts through inclined bristles or other like flexures to cause forward movement of suction head 20. Housing has a lower edge 32 which surrounds chamber 24, and secured along lower edge 32 are main bristles 34 such bristles forming something of an annulus of main bristles 34. More specifically, main bristles 34 are secured to a main-bristle ring 34*a* and such ring is removably secured to housing 22 along lower edge 32.

Figure 3:
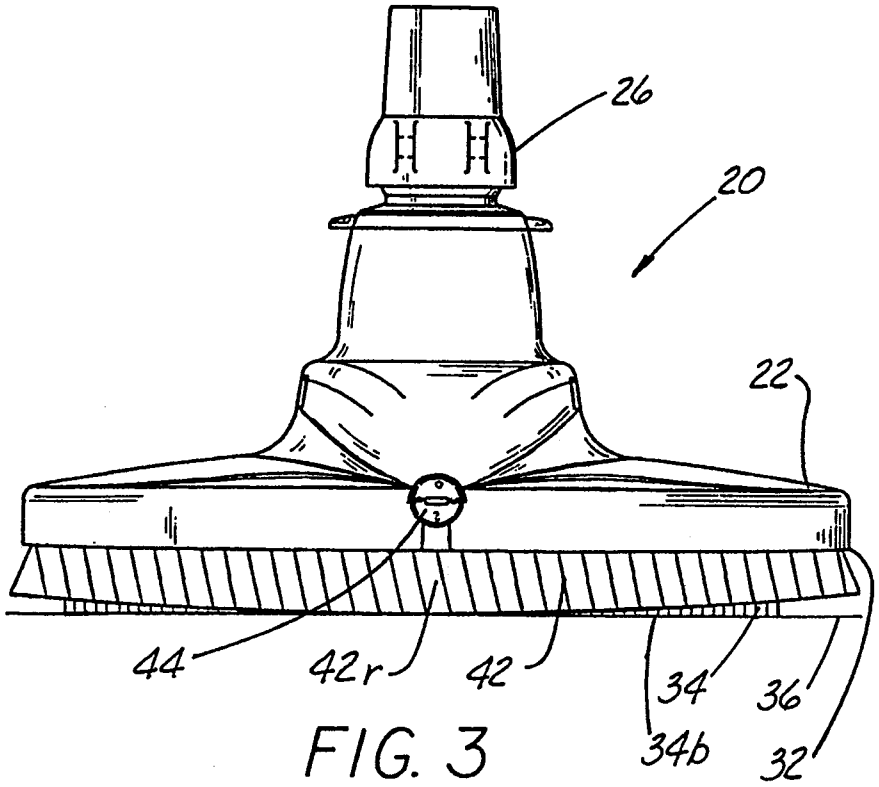
FIG. 3 is a rear elevation.

Main bristles 34 project downwardly to terminate in free main-bristle ends 34*b* which are disposed in a common plane and support suction head 20 on an underwater swimming pool surface to be cleaned. FIGS. 2–4 include a reference line 36 which is representative of a planar horizontal pool bottom surface, that is, a surface to be cleaned; as shown in FIGS. 2–4, such line is also representative of the common plane in which main-bristle ends 34*b* are disposed, given that in such views suction head 20 is supported by surface 36. The orientation of bristles will be described herein by reference to a vertical direction with respect to a horizontal surface such as that represented by reference line 35.

Figure 14:
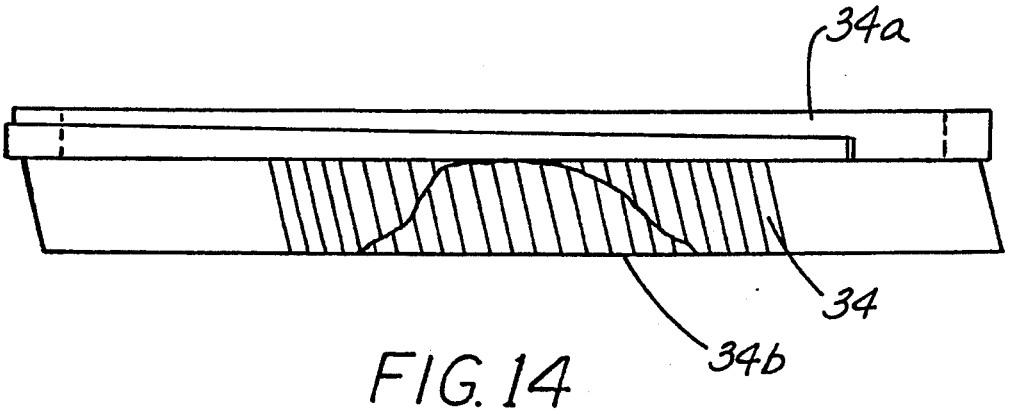
FIG. 14 is a partially cutaway side elevation of the main-bristle ring.

Main bristles 34 are affixed to main-bristle ring 34*a* at an angle; they deviate from vertical in a common direction at all locations about ring 34*a*. Such inclination, or deviation from vertical, is preferably about 8° to 18°, more preferably about 10° to 14°, with about 12° most preferred. This inclination of main bristles 34 about main-bristle ring 34*a* is illustrated best in FIG. 14, the breakaway portion of which shows that bristles on the far side of main-bristle ring 34*a* are angled in the same direction as those on the near side. Vibration of housing 22, acting through the combined rapid small motions of the many main bristles 34 about ring 34*b*, causes forward motion of suction head 20.

Suction head 20 has three groups of secondary bristles. These include two inside secondary-bristle groups 38 and 40 and an outer annulus of side secondary bristles 42 on secondary-bristle ring 42*a*. All of such secondary bristles, during operation of suction head 20, are in fixed vertical positions, although adjustment is possible with respect to bristles 42 of secondary-bristle ring 42*a*. All of such secondary bristles are inclined, that is, deviate with respect to the vertical direction. Such angle of inclination is preferably about 8° to 18°, more preferably about 10° to 14°, with about 12° most preferred, but such bristles are mounted so that most are inclined in a direction or directions different than the direction of inclination of main bristles 34.

As earlier described, contact of secondary-bristle ends with the surface to be cleaned as suction head 20 moves therealong such surface causes turning in the direction of movement of suction head 20. That is, the vibration causes a turning of the head away from the forward direction by virtue of the vibratory action of the secondary bristles—as with the main bristles, but in a different, and therefore turning, direction. The extent of turning depends on the extent of secondary bristle end contact with the surface to be cleaned.

Secondary-bristle groups 38 and 40 are secured to the downwardly-facing middle surface 22*a* of housing 22, a surface surrounded by housing lower edge 32. See FIGS. 6–9 and 16. Secondary bristle groups 38 and 40 are secured to bristle blocks 38*a* and 40*a*, respectively, which are secured with respect to housing 22 such that the bristles of bristle groups 38 and 40 are in fixed vertical positions, with their bristle ends 38*b* and 40*b* at or about at the aforementioned common plane which is defined by main-bristle ends 34*b*.

Figure 6:
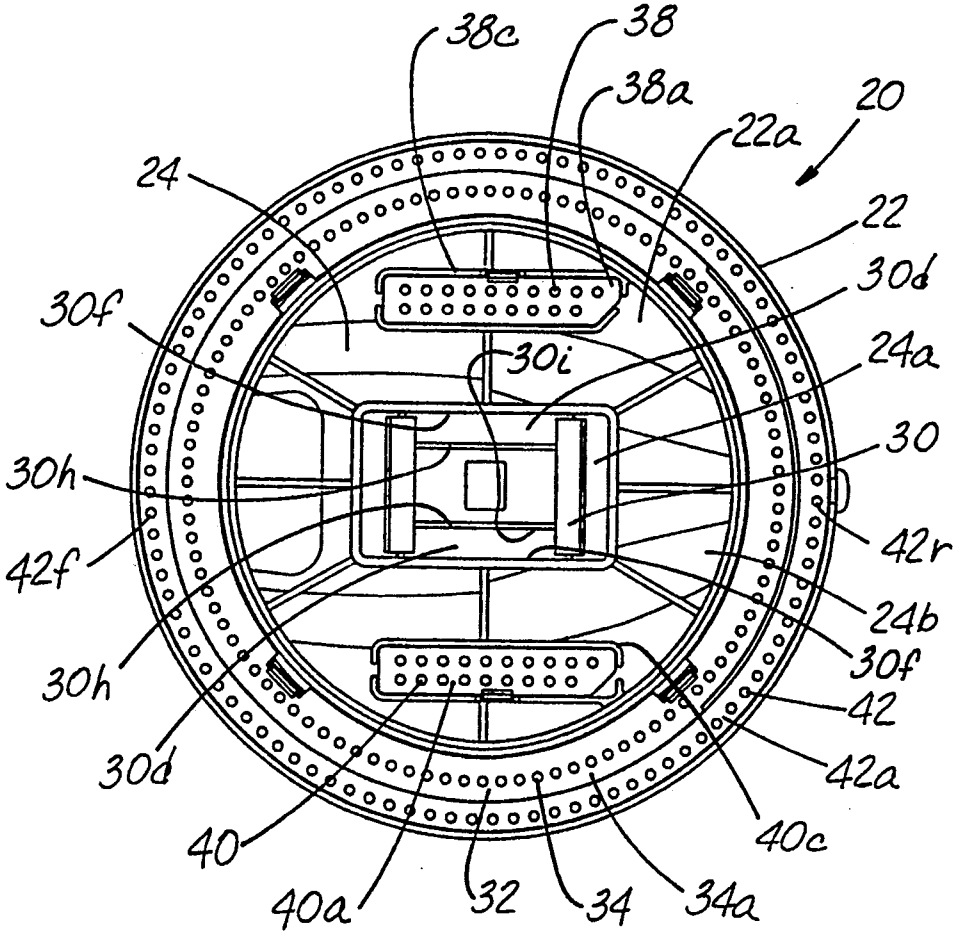
FIG. 6 is a bottom plan view.
Figure 5:
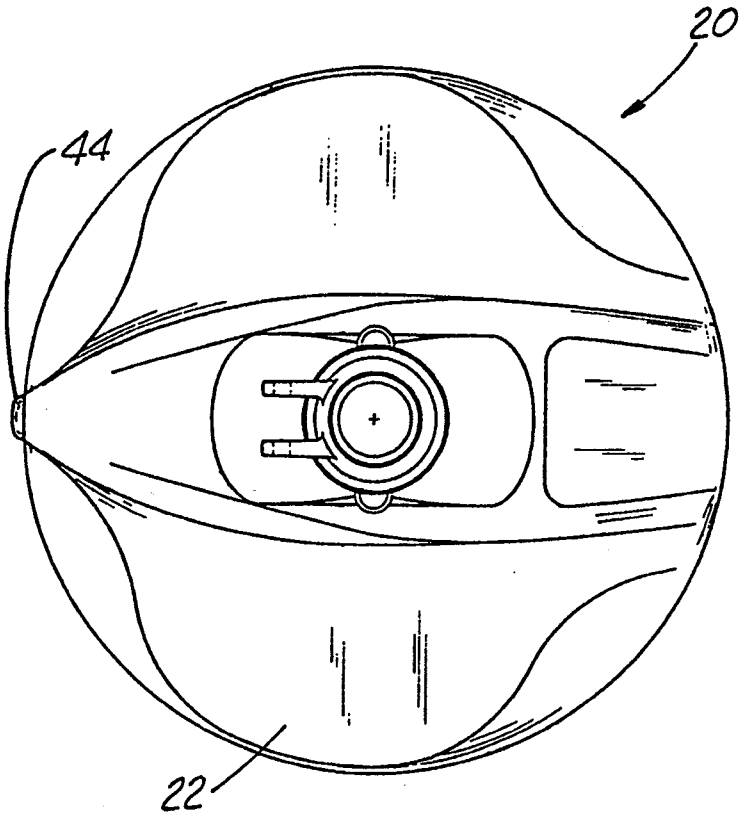
FIG. 5 is a top plan view.

As shown best in FIG. 6, bristle blocks 38*a* and 40*a* are attached within securement walls 38*c* and 40*c*, respectively, which are formed on (and are part of) downwardly-facing middle surface 22*a* of housing 22. Securement wall 38*c* is shaped with a tapered corner such that one of the bristle blocks, in this case bristle block 38*a*, can be secured therein in only one orientation—that is, with its secondary bristles 38 inclined in a direction different than the direction of inclination of main-bristles 34. Bristle block 38*a* cannot be reversed in its orientation. On the other hand, securement wall 40*c* is generally rectangular in shape without any irregular features which would limit the manner in which bristle block 40*a* is inserted therein.

Thus, bristle block 40*a* may be removed, reversed in orientation, reinserted and reattached within securement wall 40*c*, allowing its secondary bristles to be in either of at least two different orientations. The illustrated arrangement has secondary bristle groups 38 and 40 inclined in opposite directions—that is, in a common direction when considered rotationally—and this serves to impart an enhanced rotational motion to suction head 20, thus facilitating turning of suction head 22 from its direction of forward movement.

It has been found that the irregularities in the otherwise flat underwater surfaces of swimming pools—that is, portions which are off-flat or off-smooth surface—interact with secondary bristles as suction head 20 moves about a swimming pool under the vibratory action of main-bristles 34. More turning is achieved if the ends of the secondary bristles protrude more from the bottom of housing 22; less turning is achieved if the secondary-bristle ends are recessed a bit. It has been found that locating secondary bristle groups 38 and 40 such that bristle ends **38*b* and 40*b* are at or very near the aforementioned common plane provides ample random turning action. This turning action can be either enhanced or controlled by reversal of the orientation of bristle group 40**.

Figure 8:
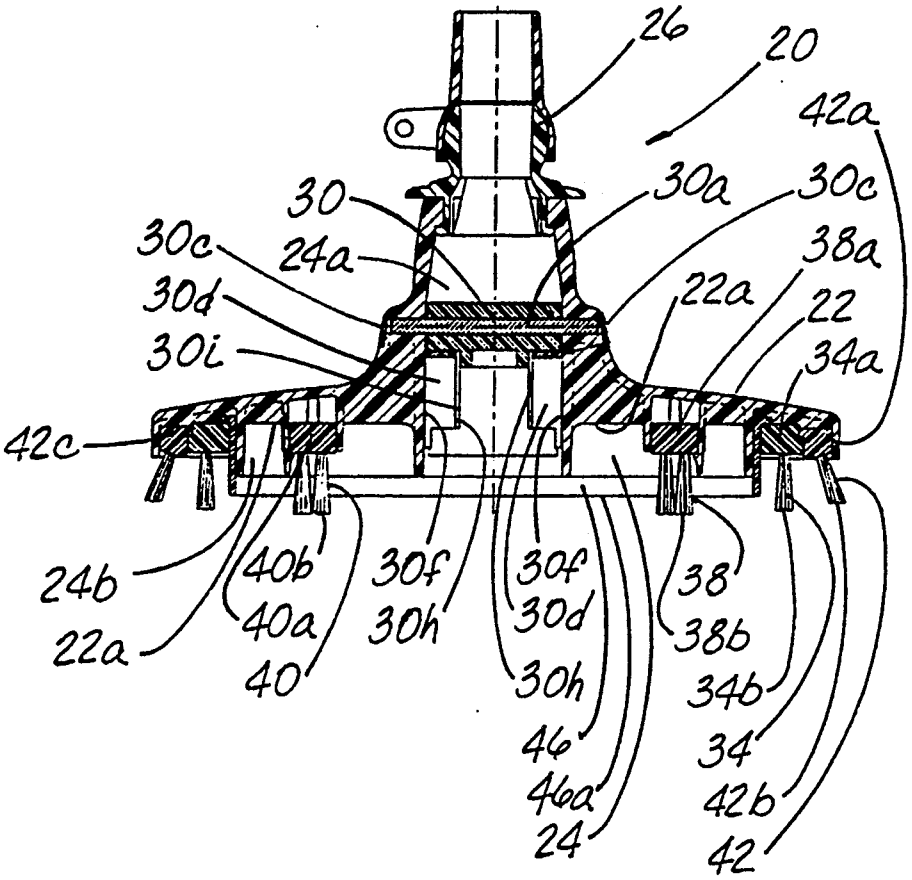
FIG. 8 is a sectional view taken along section 8—8 as indicated in FIG. 5.

As shown in FIGS. 2–4 and 6–9, best in FIGS. 8 and 9, ring **42*a* to which secondary bristles 42 (that is, "side" secondary bristles) are secured, is secured to housing lower edge 32 in a position which is concentric with main-bristle ring 34*a* at a position outside (that is, radially outside) main-bristle ring 34*a*. Both rings 34*a* and 42*a* are removably secured along lower edge 32**, and may therefore be replaced when worn.

Figure 15:
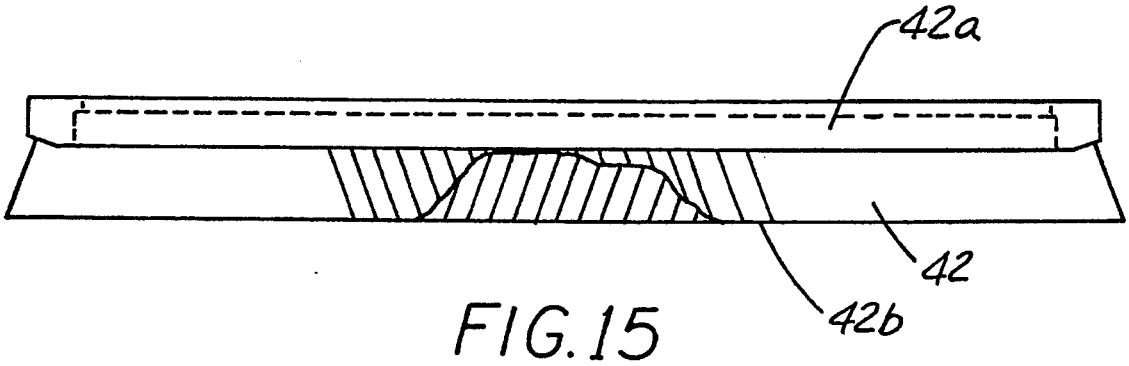
FIG. 15 is a partially cutaway side elevation of the secondary-bristle ring.
Figure 16:
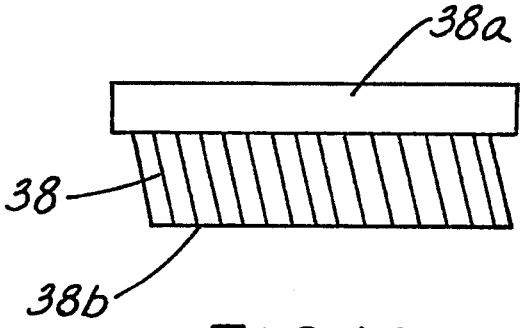
FIG. 16 is a partially cutaway side elevation of a secondary-bristle group.

Side secondary bristles 42 project both outwardly and downwardly and terminate short of the common plane indicated by reference line 36 (in FIGS. 2–4). As shown in FIG. 15, which includes a breakaway portion allowing illustration of bristle orientations on both the near side and the far side of secondary-bristle ring **42*a*, secondary bristles 42 are disposed at a common rotational angle—about 12° to vertical—such that engagement of bristle ends 42*b* with pool bottom surfaces causes a turning deflection of suction head 20. And, in addition to such rotational angle, bristles 42 are oriented to project radially outwardly, preferably about 16° to 24° from vertical, most preferably about 20°. This facilitates engagement with pool side walls as they are approached by suction head 20, and the combination of rotational and radial angling causes turning of suction head 20** when such bristles hit a side wall.

As shown in FIGS. 2–4, 6 and 9, secondary-bristle ring **42*a* is in a tilted orientation such that the ends of its rear bristles 42*r*, that is, its bristles generally along the rear circumferential portion of ring 42*a*, are at a lower position than are the ends of its front bristles 42*f*, that is, its bristles generally along the front circumferential portion of ring 42. The ends of the bristles of secondary-bristle ring 42 at circumferential portions between the front and the rear are at levels therebetween. The rear circumferential portion of secondary-bristle ring 42*a* is referred to herein as a low circumferential portion. Its level is because of the tilt of ring 42; all bristles 42** are of substantially equal lengths.

Not only is ring **42*a* tilted, but the extent of tilt of ring 42*a* is adjustable. As shown in FIGS. 8 and 9, the upper surface of ring 42*a* is against ring-placement surface 42*c* which is part of the under surface of housing 22 along housing lower edge 32. Ring-placement surface 42*c*, while planar, is tilted with respect to a horizontal plane such that ring 42*a*** is tilted.

Figure 12:
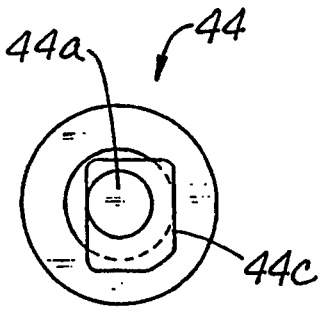
FIG. 12 is a left side elevation of FIG. 10, showing the other end of the height adjustment device.
Figure 10:
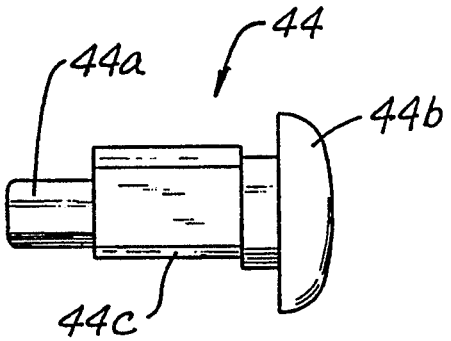
FIG. 10 is a side view of an adjustment device for which is used for adjusting the vertical position of a portion of the secondary-bristle ring.
Figure 11:
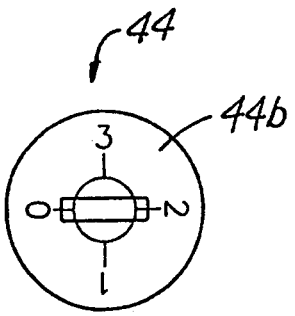
FIG. 11 is a right side elevation of FIG. 10, showing the head of the adjustment device.

As illustrated best in FIG. 9, between the rear circumferential portion of ring **42*a* and the adjacent portion of ring-placement surface 42*c* is a tilt-adjuster 44. Tilt-adjuster 44, shown in detail in FIGS. 10–12, has an inner end which is rotatably secured to housing 22, an outer end 44*b* by which the rotational orientation of tilt-adjuster 44 is set (for example, by using a screw driver), and a middle camming portion 44*c*. As shown best in FIG. 12, camming portion 44*c* has four sides, each of such sides having a different spacing from the axis of tilt-adjuster 44**.

In the embodiment illustrated, tilt-adjuster 44 adjusts the tilt of secondary-bristle ring **42*a* between an orientation in which the ends of rear bristles 42*r* are at about the level of common plane 36 (and, thus, at about the level of main-bristle ends 34*b*) and an orientation in which the ends of rear bristles 42*r* are about three millimeters above common plane 36. Adjustments can be made to intermediate positions in which the ends of rear bristles 42*r* are either one or two millimeters above common plane 36. Outer end 44*b* of tilt-adjuster 44 is marked as a guide for such adjustment. When in its highest position of adjustment, the ends of front bristles 42*f* are still at a level about three millimeters above the level of the ends of rear bristles 42*r***.

This adjustability in the vertical positions of secondary-bristle ends **42*b* provides a further way to assure that the turning action provided by the secondary bristles of suction head 20** is appropriate for effective cleaning of a particular swimming pool.

As illustrated in FIGS. 6–9, a skirt 46, which is concentric with bristle rings **34*a* and 42*a*, projects downwardly from housing 22 at a position radially inside main-bristle ring 34. Bristle rings 34*a* and 42*a* and skirt 46 are dimensioned and configured for engagement with one another to facilitate assembly of suction head 20. Skirt 46 extends downwardly to a skirt lower edge 46*a* which is spaced well above the ends of both main bristles 34 and secondary bristles 42, that is, above the ends of the bristles of both bristle rings. Such spacing determines the gap through which water and debris will pass in entering housing chamber 24**, and the gap must be small enough to assure sufficient turbulence of water flow at and between bristles as they engage the pool surface to be cleaned, and large enough to allow passage of dirt and debris.

Many other variations are possible in arrangement and configuration of main bristles, secondary bristles and bristle groups, and other parts as required. It should be noted that the term "bristles" is used herein to refer to any flexible and resilient flexure material which can extend downwardly, as common bristles do (as shown), to support the suction head housing and allow its advance by means of the action of the material when housing 22 is vibrating. In addition to the brush-like bristles illustrated, thicker members which are flexible and resilient and wall-like materials are included. It is important only that vibration act through such material members to cause forward movement of suction head 20.

The parts of this invention may be made using known materials, and molding and forming methods well known to those skilled in the art. Housing 22, vibrator 30, hose connector 26, tilt-adjuster 44, and the rings and blocks for bristle mounting are preferably made of suitable rigid plastics. Housing 22 can be molded with all or most of its required functional elements and features integrally formed as parts or features thereof. The bristles are preferably made of common bristle materials which are flexible and resilient, and thus facilitate the moving actions described above. Sliding seals **30*d*** are made of fairly rigid seal materials, one preferred material being a Dupont Delrin acetal material.

A wide variation of materials, part manufacturing methods and assembly methods can be used.

While the principles of this invention have been described in connection with specific embodiments, it should be understood clearly that these descriptions are made only by way of example and are not intended to limit the scope of the invention.

We claim:

1. In a swimming pool cleaner suction head of the type having a housing, a chamber open at its lower side and a hose connection by which a pump causes water flow through the chamber and into the hose, the improvement comprising:

a vibrator device secured to the housing to vibrate the head in response to water flow through the chamber;

flexible main bristles secured with respect to the housing and projecting downwardly to terminate in free main-bristle ends disposed substantially in a common plane and adapted to support the head on a surface to be cleaned, a preponderance of the main bristles inclined such that, when their ends engage a horizontal surface, the main bristles deviate from vertical in a common direction and vibration causes forward head movement; and at least one group of vertically-fixed secondary flexible bristles secured with respect to the housing and projecting downwardly to terminate in secondary-bristle ends positioned for bristle-end engagement with the surface to be cleaned, the secondary bristles deviating from vertical in other than the common direction such that, upon contact of secondary-bristle ends with the surface to be cleaned, vibration causes a turning of the head away from the forward direction.

2. The device of claim 1 wherein the secondary-bristle ends are positioned with respect to the common plane to at least periodically engage off-planar portions of the surface to be cleaned, whereby turning at least intermittently occurs.

3. The device of claim 2 wherein:

the housing has a lower edge surrounding the chamber;

the main bristles are secured along the lower edge of the housing; and the at least one secondary-bristle group is at a position spaced from the lower edge.

4. The device of claim 3 wherein the housing has a downwardly-facing middle surface surrounded by the lower edge and the at least one secondary-bristle group is secured to the middle surface.

5. The device of claim 3 including a pair of the secondary-bristle groups disposed on opposite sides of a center of the head.

6. The device of claim 5 wherein at least one of the secondary-bristle groups is removably secured with respect to the housing and secured with its secondary bristles in one of at least two different orientations.

7. The device of claim 5 wherein the bristles of such two secondary-bristle groups are oppositely inclined to one another to impart an enhanced rotational motion to the suction head, thereby to facilitate turning.

8. The device of claim 3 further including side bristles affixed along the lower edge at positions outside the main bristles, such side bristles projecting both outwardly and downwardly to terminate short of the common plane and being disposed at a rotational angle, whereby engagement of the side bristles with pool walls causes a turning deflection of the pool cleaner.

9. The device of claim 8 wherein the housing has a downwardly-facing middle surface surrounded by the lower edge and the at least one secondary-bristle group is secured to the middle surface.

10. The device of claim 8 wherein:

the main bristles are secured to a main-bristle ring which is removably secured along the lower edge of the housing; and the side bristles are secured to a side-bristle ring which is removably secured along the lower edge of the housing outside the main-bristle ring.

11. The device of claim 10 further including a tilt mechanism engaging the side-bristle ring to adjust its orientation with respect to the common plane.

12. The device of claim 1 wherein:

the housing has a lower edge surrounding the chamber;

the vertically-fixed secondary flexible bristles are affixed along the lower edge, the secondary bristles projecting both outwardly and downwardly and being disposed at a rotational angle such that their engagement with pool side surfaces causes a turning deflection of the pool cleaner.

13. The device of claim 12 wherein the main bristles are secured along the lower edge of the housing, the secondary bristles being positioned outside the main bristles.

14. The device of claim 13 wherein the main bristles are secured to a main-bristle ring which is removably secured along the lower edge of the housing.

15. The device of claim 14 wherein the secondary bristles are secured to a secondary-bristle ring which is removably secured along the lower edge of the housing.

16. The device of claim 13 wherein the secondary bristles are secured to a secondary-bristle ring which is secured along the lower edge of the housing.

17. The device of claim 16 wherein the secondary-bristle ring has a low circumferential portion, the secondary bristles of which have ends closer to the common plane than the ends of the other secondary bristles on the secondary-bristle ring.

18. The device of claim 17 further including a tilt mechanism engaging the secondary-bristle ring to adjust its orientation, whereby the ends of the secondary bristles along the low circumferential portion of the secondary-bristle ring may be adjusted toward or away from the common plane.

19. The device of claim 18 wherein the tilt mechanism is a camming device to raise and lower the low circumferential portion of the secondary-bristle ring.

20. The device of claim 17 wherein the secondary-bristle ring includes a front portion, an opposite rear portion, and portions therebetween, the rear portion being the low circumferential portion.

21. In a swimming pool cleaner suction head of the type having a housing, a chamber open at its lower side and a hose connection by which a pump causes water flow through the chamber and into the hose, the improvement comprising:

a vibrator device secured to the housing to vibrate the head in response to water flow through the chamber;

main flexures secured with respect to the housing and projecting downwardly to terminate in main-flexure ends adapted to support the head on a surface to be cleaned, the main flexures inclined such that, when their ends engage a horizontal surface, they deviate from vertical to an extent that vibration causes forward head movement; and vertically-fixed secondary flexures secured with respect to the housing and projecting downwardly to terminate in secondary-flexure ends positioned for off-center engagement with the surface to be cleaned, the secondary flexures deviating from vertical in other than the direction of main-flexure deviation such that, upon contact of secondary-flexure ends with the surface to be cleaned, vibration causes a turning of the head away from the forward direction.

22. An automatic swimming pool cleaner of the type driven by the water flow therethrough, comprising:

a housing forming a chamber open at its lower side and having a hose connection thereon;

a vibrator secured to the housing to vibrate the housing;

main bristles secured With respect to the housing and projecting downwardly to terminate in main-bristle ends for supporting the pool cleaner on a surface to be cleaned, the main bristles inclined in a first direction such that vibration causes forward movement; and secondary bristles in fixed position with respect to the housing and projecting downwardly to terminate in secondary-bristle ends positioned for engagement with the surface to be cleaned, the secondary bristles inclined in a second direction such that, upon contact thereof with the surface to be cleaned, vibration causes a turning away from the forward direction.

* * * * *

UNITED STATES PATENT AND TRADEMARK OFFICE

CERTIFICATE OF CORRECTION

PATENT NO. : 5,379,473

DATED : January 10, 1995

INVENTOR(S) : Dieter J. Rief and Herman E. Frentzel

It is certified that error appears in the above-indentified patent and that said Letters Patent is hereby corrected as shown below:

In column 7, line 35, change "23" to —13—.

Signed and Sealed this

Twenty-eight Day of March, 1995

*Attest:*

Bruce Lehman

BRUCE LEHMAN

*Attesting Officer*

*Commissioner of Patents and Trademarks*